US008782903B2

(12) United States Patent
Clarke et al.

(10) Patent No.: US 8,782,903 B2
(45) Date of Patent: Jul. 22, 2014

(54) SHAVING RAZOR COMB GUARD FOR A TRIMMING BLADE

(75) Inventors: Sean Peter Clarke, Highmoor Cross (GB); Paul Leslie Warrick, Reading (GB); Trevor John Whelan, Thatcham (GB)

(73) Assignee: The Gillette Company, Boston, MA (US)

( * ) Notice: Subject to any disclaimer, the term of this patent is extended or adjusted under 35 U.S.C. 154(b) by 565 days.

(21) Appl. No.: 12/713,244

(22) Filed: Feb. 26, 2010

(65) Prior Publication Data

US 2010/0299928 A1 Dec. 2, 2010

Related U.S. Application Data

(60) Provisional application No. 61/182,206, filed on May 29, 2009.

(51) Int. Cl.
*B26B 21/00* (2006.01)
*B26B 21/12* (2006.01)

(52) U.S. Cl.
USPC ..... 30/34.1; 30/50; 30/77

(58) Field of Classification Search
CPC ..... B26B 21/00; B26B 21/02; B26B 21/12; B26B 21/18; B26B 21/40; B26B 21/4012; B26B 21/4018; B26B 21/4025
USPC ..... D28/46, 47; 30/34.1, 34.2, 47, 49–51, 30/59, 65, 70, 73, 74.1, 77–82
See application file for complete search history.

(56) References Cited

U.S. PATENT DOCUMENTS

| | | | | | |
|---|---|---|---|---|---|
| 903,347 | A | * | 11/1908 | Watson | 30/82 |
| 1,247,266 | A | * | 11/1917 | Hartman | 30/70 |
| 1,272,816 | A | * | 7/1918 | Leslie | 30/50 |
| 1,633,139 | A | * | 6/1927 | Staats-Oels | 30/50 |

(Continued)

FOREIGN PATENT DOCUMENTS

| | | | | |
|---|---|---|---|---|
| BR | PI0714402 | A2 | * | 3/2013 |
| DE | 202013003009 | U1 | * | 6/2013 |

(Continued)

OTHER PUBLICATIONS

PCT International Search Report with Written Opinion in corresponding Int'l appln. PCT/US2010/035541 dated Aug. 30, 2010.

*Primary Examiner* — Jason Daniel Prone
(74) *Attorney, Agent, or Firm* — Joanne N. Pappas; Kevin C. Johnson; Steven W. Miller

(57) ABSTRACT

A shaving razor blade unit including a housing having a primary guard at a front of the housing and a primary cap at an upper surface at a back of the housing. One or more primary shaving blades are positioned between the primary guard and the primary cap. A trimming blade is mounted at the back of the housing and has a cutting edge. A trimming comb guard is located at the back of the housing. The trimming comb guard has a plurality of projections along a length of the trimming comb guard defining a plurality of open slots extending generally perpendicular to the cutting edge. The open slots have a minimum width of about 0.20 mm to about 0.49 mm for allowing the free passage of hair during shaving.

18 Claims, 7 Drawing Sheets

(56) References Cited

U.S. PATENT DOCUMENTS

| | | | | | |
|---|---|---|---|---|---|
| 1,833,242 | A | * | 11/1931 | Connolly | 30/82 |
| 2,126,728 | A | * | 8/1938 | Buell | 30/77 |
| 2,588,033 | A | * | 3/1952 | O'Gatty | 30/79 |
| 2,750,663 | A | * | 6/1956 | Coles | 30/74.1 |
| 2,766,521 | A | * | 10/1956 | Benvenuti | 30/34.2 |
| 2,778,104 | A | * | 1/1957 | Coles | 30/77 |
| 2,782,499 | A | * | 2/1957 | Grey | 30/77 |
| 2,807,084 | A | * | 9/1957 | Harman | 30/50 |
| 3,004,337 | A | * | 10/1961 | Schweizer | 30/77 |
| 4,044,463 | A | | 8/1977 | Tietjens | |
| 4,069,580 | A | * | 1/1978 | Cartwright et al. | 30/50 |
| 4,241,501 | A | * | 12/1980 | Westlake, Jr. | 30/59 |
| 4,310,968 | A | | 1/1982 | Buik et al. | |
| 4,409,735 | A | * | 10/1983 | Cartwright et al. | 30/77 |
| 4,443,939 | A | * | 4/1984 | Motta et al. | 30/81 |
| 4,516,320 | A | * | 5/1985 | Peleckis | 30/50 |
| 4,535,537 | A | | 8/1985 | Ferraro et al. | |
| 4,562,645 | A | | 1/1986 | Dato et al. | |
| 4,741,103 | A | | 5/1988 | Hultman | |
| 4,854,043 | A | | 8/1989 | Chen | |
| 4,976,028 | A | * | 12/1990 | Chen | 30/49 |
| 4,998,347 | A | | 3/1991 | Schachter | |
| 5,003,694 | A | * | 4/1991 | Chen | 30/49 |
| 5,031,316 | A | | 7/1991 | Oldroyd | |
| 5,063,667 | A | | 11/1991 | Jacobson | |
| 5,133,131 | A | * | 7/1992 | Hoffman | 30/50 |
| 5,185,927 | A | * | 2/1993 | Rivers | 30/50 |
| 5,191,712 | A | | 3/1993 | Crook et al. | |
| 5,313,705 | A | | 5/1994 | Rivers et al. | |
| 5,365,665 | A | | 11/1994 | Coffin | |
| 5,386,750 | A | * | 2/1995 | Morrison | 30/31 |
| 5,388,332 | A | | 2/1995 | Oldroyd | |
| 5,410,810 | A | | 5/1995 | Gillibrand | |
| 5,475,923 | A | | 12/1995 | Ferraro | |
| 5,526,567 | A | | 6/1996 | Carson, III et al. | |
| 5,590,468 | A | | 1/1997 | Prochaska | |
| 5,671,534 | A | * | 9/1997 | Mayerovitch | 30/50 |
| 5,802,721 | A | | 9/1998 | Wain et al. | |
| 5,953,819 | A | | 9/1999 | Simms et al. | |
| D423,143 | S | * | 4/2000 | Cowell | D28/46 |
| 6,052,905 | A | * | 4/2000 | Branchinelli et al. | 30/50 |
| 6,055,731 | A | | 5/2000 | Zucker | |
| 6,085,421 | A | | 7/2000 | Jorna et al. | |
| 6,233,829 | B1 | | 5/2001 | Oglesby et al. | |
| 6,243,951 | B1 | | 6/2001 | Oldroyd | |
| 6,276,061 | B1 | * | 8/2001 | Rozenkranc | 30/34.1 |
| 6,305,084 | B1 | | 10/2001 | Zucker | |
| 6,516,518 | B1 | * | 2/2003 | Garraway et al. | 30/34.2 |
| 6,550,141 | B1 | | 4/2003 | Rivers et al. | |
| 6,941,659 | B2 | | 9/2005 | Gilder | |
| D513,540 | S | * | 1/2006 | Wonderley | D28/46 |
| 7,111,401 | B2 | | 9/2006 | Richard | |
| D552,795 | S | * | 10/2007 | Wonderley | D28/46 |
| 7,322,109 | B2 | * | 1/2008 | Newkirk et al. | 30/50 |
| D588,308 | S | * | 3/2009 | Wonderley | D28/46 |
| D588,309 | S | * | 3/2009 | Wonderley | D28/47 |
| D615,704 | S | * | 5/2010 | Wonderley et al. | D28/46 |
| 7,761,999 | B2 | * | 7/2010 | Macove | 30/34.1 |
| D625,882 | S | * | 10/2010 | Wonderley et al. | D28/46 |
| D625,883 | S | * | 10/2010 | Wonderley | D28/47 |
| D633,252 | S | * | 2/2011 | Wonderley | D28/46 |
| D633,253 | S | * | 2/2011 | Wonderley et al. | D28/47 |
| D640,004 | S | * | 6/2011 | Wonderley et al. | D28/46 |
| D640,414 | S | * | 6/2011 | Wonderley et al. | D28/46 |
| D643,977 | S | * | 8/2011 | Wonderley et al. | D28/47 |
| 8,209,867 | B2 | * | 7/2012 | Clarke | 30/34.2 |
| 8,429,826 | B2 | * | 4/2013 | Clarke | 30/34.2 |
| D699,892 | S | * | 2/2014 | Wonderley | D28/47 |
| 8,661,689 | B2 | * | 3/2014 | Fathallah et al. | 30/34.2 |
| 2003/0159291 | A1 | | 8/2003 | Clark | |
| 2004/0103538 | A1 | * | 6/2004 | Dansreau et al. | 30/34.2 |
| 2005/0126007 | A1 | | 6/2005 | Aviza | |
| 2005/0198829 | A1 | | 9/2005 | Gray et al. | |
| 2005/0246898 | A1 | | 11/2005 | Gilder | |
| 2006/0277759 | A1 | | 12/2006 | Follo | |
| 2007/0283567 | A1 | * | 12/2007 | Magli | 30/50 |
| 2008/0250647 | A1 | | 10/2008 | Fischer et al. | |
| 2009/0126196 | A1 | | 5/2009 | Gilder et al. | |
| 2009/0188112 | A1 | * | 7/2009 | Prochaska et al. | 30/77 |
| 2009/0255124 | A1 | * | 10/2009 | Hasbani | 30/50 |
| 2010/0071214 | A1 | * | 3/2010 | Kinghorn | 30/34.1 |
| 2010/0071215 | A1 | * | 3/2010 | Wonderley | 30/34.1 |
| 2010/0083510 | A1 | | 4/2010 | Clarke | |
| 2011/0023305 | A1 | * | 2/2011 | Whelan et al. | 30/34.1 |
| 2011/0146079 | A1 | * | 6/2011 | Clarke et al. | 30/34.05 |
| 2011/0225828 | A1 | * | 9/2011 | Bruno | 30/50 |
| 2012/0317818 | A1 | * | 12/2012 | Oglesby et al. | 30/77 |
| 2014/0000114 | A1 | * | 1/2014 | Wester et al. | 30/32 |
| 2014/0033538 | A1 | * | 2/2014 | Peterson et al. | 30/50 |

FOREIGN PATENT DOCUMENTS

| | | | | |
|---|---|---|---|---|
| EP | 0 477 132 | A1 | | 3/1992 |
| EP | 2461949 | A1 | * | 6/2012 |
| GB | 2 413 980 | A | | 11/2005 |
| WO | WO 2009049216 | A1 | * | 4/2009 |
| WO | WO 2009108855 | A2 | * | 9/2009 |
| WO | WO 2010039749 | A1 | * | 4/2010 |
| WO | WO 2010132227 | A1 | * | 11/2010 |
| WO | WO 2010138371 | A1 | * | 12/2010 |
| WO | WO 2011017239 | A1 | * | 2/2011 |
| WO | WO 2011115782 | A1 | * | 9/2011 |
| WO | WO 2011071350 | A3 | * | 11/2011 |
| WO | WO 2012033362 | A2 | * | 3/2012 |
| WO | WO 2013187695 | A1 | * | 12/2013 |

* cited by examiner

SHAVING RAZOR COMB GUARD FOR A TRIMMING BLADE

CROSS REFERENCE TO RELATED APPLICATIONS

This application claims the benefit of U.S. Provisional Application No. 61/182,206, filed on May 29, 2009.

FIELD OF THE INVENTION

The present invention relates to shaving razors and more particularly to shaving razor blade units having a housing with a trimming blade having a comb guard.

BACKGROUND OF THE INVENTION

In recent years shaving razors with various numbers of blades have been proposed in the patent literature and commercialized such as the three-bladed Mach III™ razor and the five bladed Fusion™ razor by The Gillette Company.

Increasing the number of blades on a shaving razor generally tends to increase the shaving efficiency of the razor and provide better distribution of compressive forces on the skin but it can also tend to increase drag forces, reduce maneuverability, and reduce the ability to trim, e.g., sideburns or near the nose. To solve this problem an extra blade can be mounted at the rear of the razor housing for trimming.

Short hairs are typical of hair growth of approximately twenty-four hours. Standard shaving razors cut shorter hairs rather effectively because the short hairs have a tendency to stand straight up. The edge of a trimming blade on the razor is able to cut the short hair at an optimum angle. Longer hairs typically bend over as they grow and lay flat on the skin. The trimming blade will have the tendency to skive or cut the longer hair at a more parallel angle to the skin surface. Some longer hairs may lie flat such that the trimming blade is unable to cut them. The user may have to trim the same area repeatedly to cut hairs that were either uncut or not cut close enough to the skin surface.

It is therefore desirable to provide a shaving razor with a trimming blade having a guard that provides superior long hair cutting performance.

SUMMARY OF THE INVENTION

In one aspect, the invention features, in general, a shaving razor blade unit including a housing having a primary guard at a front of the housing and a primary cap at an upper surface at a back of the housing, one or more primary shaving blades positioned between the primary guard and the primary cap, a rear wall having a rear exterior surface extending downward from the upper surface at the back of the housing to a terminating surface, a trimming blade mounted at the back of the housing and having a trimming cutting edge and a trimming comb guard at the back of the housing, the trimming comb guard having a plurality of projections along a length of the trimming comb guard defining a plurality of open slots extending generally perpendicular to the trimming cutting edge, wherein the open slots have a minimum width of about 0.20 mm to about 0.49 mm for allowing the free passage of hair during shaving.

The trimming comb guard may be made of sheet metal that has been cut and formed.

The open slots may have a pitch of about 0.40 mm to about 0.85 mm. The open slots may be directly adjacent the trimming blade. The open slots may have a substantially uniform width. The open slots may be generally parallel to each other.

The trimming comb guard may include at least about 50 projections along the length of the trimming comb guard.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Figure 1:
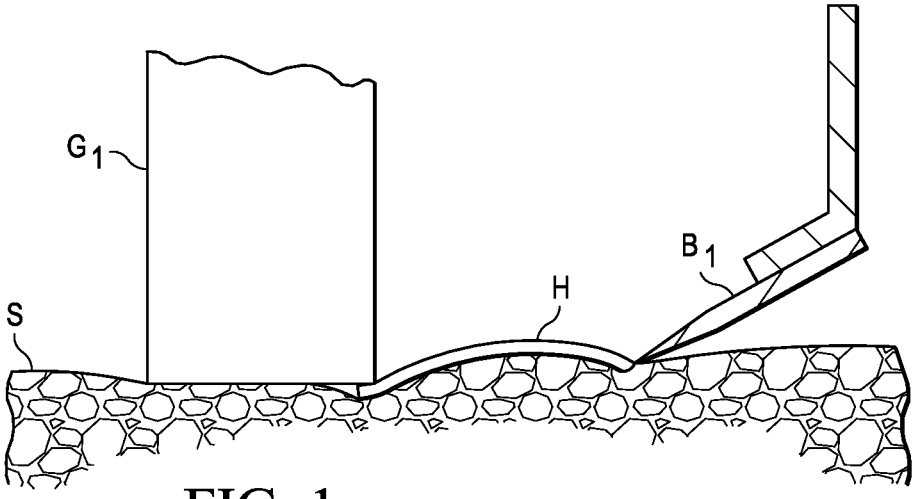
FIG. 1 (PRIOR ART)
FIG. 1 is a cross-sectional side view of a prior art shaving razor with a trimming blade cutting a hair.
Figure 2:
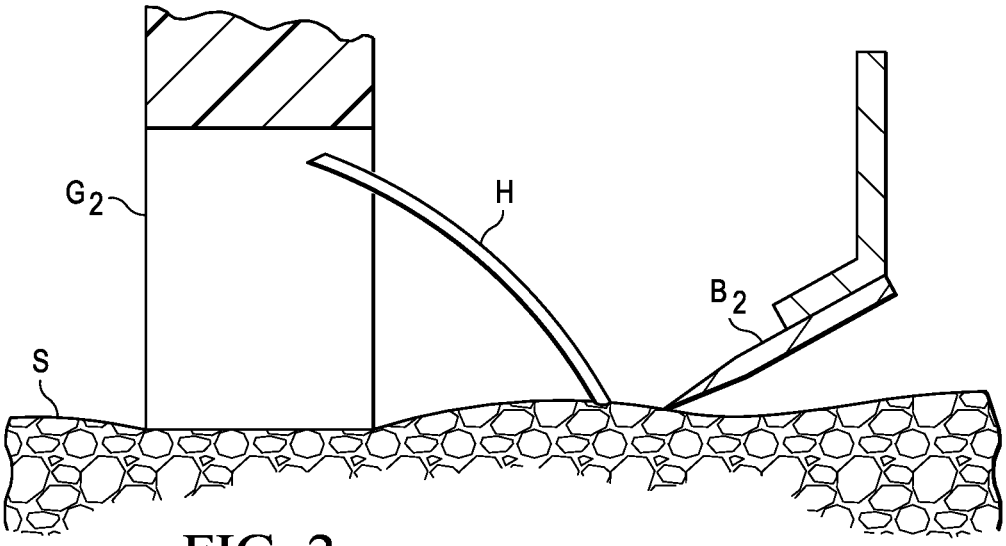
FIG. 2 is a cross-sectional side view of a hair being cut by a trimming blade on a shaving razor in accordance with certain preferred embodiments of the present disclosure.

Referring to FIG. 2, the present invention is generally related to providing a shaving razor blade unit having a housing with a trimming guard "$G_2$" that is capable of providing a passage for allowing hairs "H" to stand up from the skin "S" as they approach a trimming blade "$B_2$", thereby providing for more precise cutting of longer hairs than is possible with the prior art devices shown in FIG. 1. As illustrated in FIG. 1, standard guards "$G_1$" can trap longer hairs "H" so that they are held down against the skin "S" when the trimming blade "$B_1$" is designed to engage them, resulting in the blade "$B_1$" not properly cutting the hair "H" close to the skin surface "S".

Figure 3:
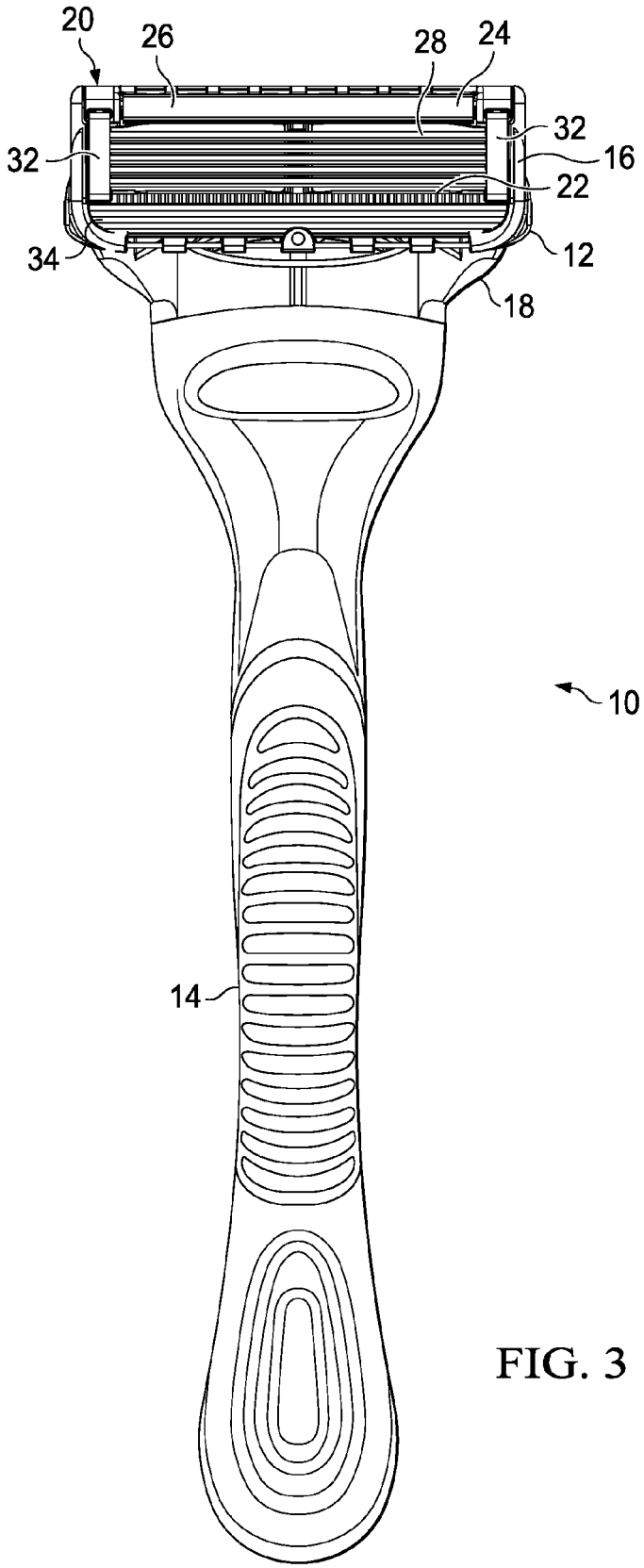
FIG. 3 is a front view of one possible embodiment of a shaving razor.

Referring to FIG. 3, shaving razor 10 includes disposable cartridge 12 and handle 14. Cartridge 12 includes a connecting member 18, which connects to handle 14, and a blade unit 16 which is pivotally connected to connecting member 18. Blade unit 16 includes plastic housing 20, primary guard 22 at the front of housing 20 and primary cap 24 at the rear of housing 20. Elongated primary shaving blades 28 are positioned between primary guard 22 and primary cap 24. Although five primary shaving blades 28 are shown it is understood that more or less primary shaving blades 28 may be mounted within the housing 20. The blades 28 are shown secured within the housing 20 with clips 32, but other assembly methods known to those skilled in the art may also be used.

The primary guard 22 may have a plurality of fins 34 spaced apart from each other that extend longitudinally along a length the housing 20. The primary cap 24 may have a lubricating strip 26.

Figure 4:
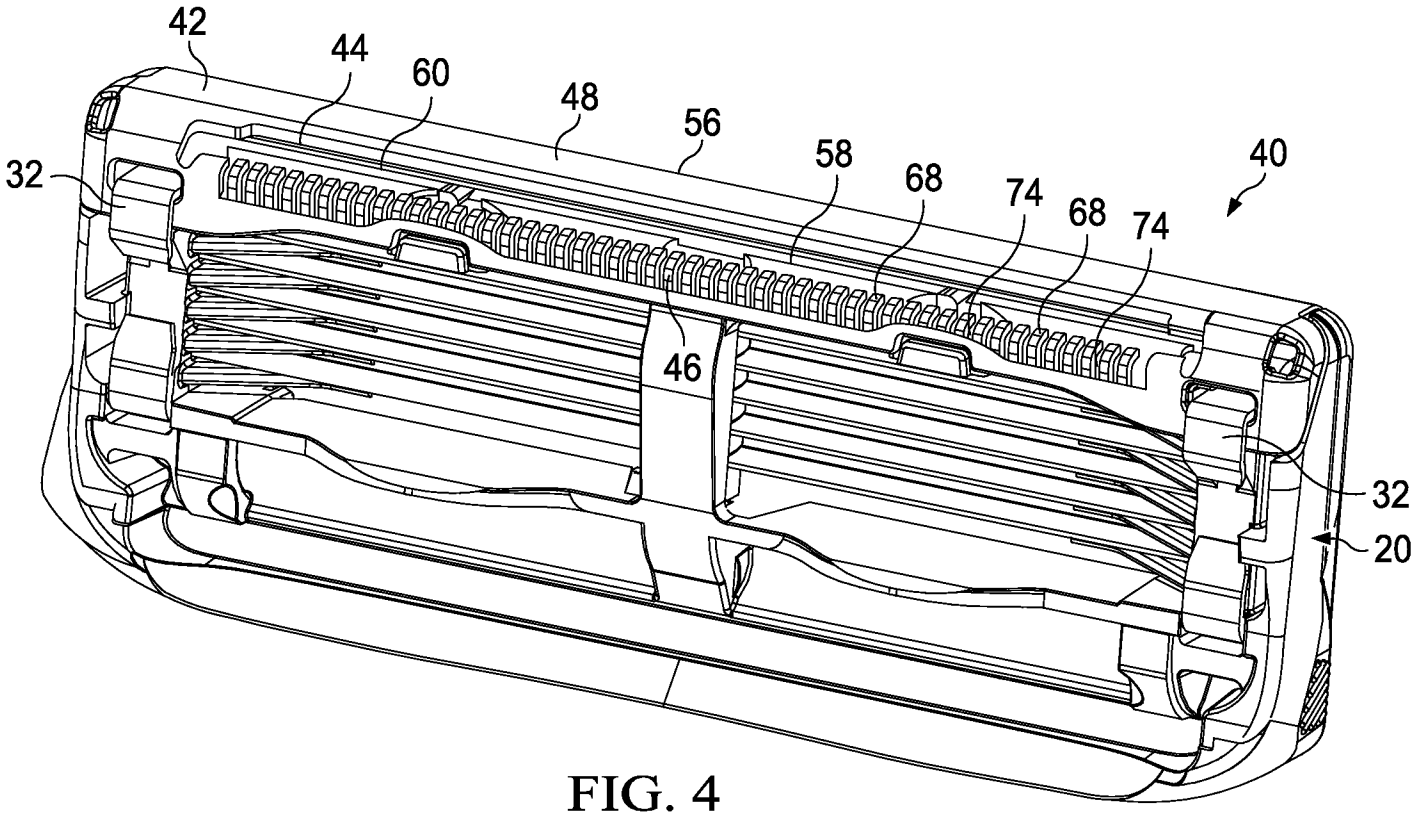
FIG. 4 is a rear perspective view of one possible embodiment of a shaving razor blade unit.

Referring to FIG. 4, trimming blade assembly 40 is secured to the back of housing 20 by clips 32. Trimming blade assembly 40 includes blade carrier 42 and trimming blade 44 mounted thereon. Trimming blade 44 includes a trimming cutting edge 60. Blade carrier 42 is made of 0.011" thick stainless steel sheet metal that has been cut and formed to provide structures for attaching to housing 20, supporting trimming blade 44, and defining a trimming comb guard 46 and a trimming cap 48.

Blade carrier 42 has a rear wall 56. The central portion of rear wall 56 is open at its lower portion, providing a gap 58 that is located between trimming cap 48 and trimming comb guard 46. Trimming blade 44 is welded to interior surface of rear wall 56 by spot welds.

The trimming comb guard 46 includes a plurality of projections 68 that extend substantially perpendicular to trimming blade 44. The projections 68 may extend along the entire length of the trimming comb guard 46, or they may extend along only certain sections of the trimming comb guard 46, such as the middle or ends. The trimming comb guard 46 may also extend only along certain sections of the housing 20, such as the middle or toward the end portions. As will be described in greater detail below, the trimming comb guard 46 and the projections 68 may be configured for the management of skin and may aid in guiding hair to the trimming blade 44. The projections 68 and the trimming comb guard 46 may orient the hair in an upward direction away from the skin surface and present it to the trimming blade 44 to provide for efficient and accurate cutting of the hair. In certain embodiments, the trimming comb guard 46 and the projections 68 may be configured for guiding longer hairs to the trimming blade 44. Long hairs may include hair that has not been shaved for longer than 48 hours. The length of such hairs may be greater than about 0.01 mm.

The plurality of projections 68 of the trimming comb guard 46 may define a plurality of slots 74 dimensioned for one or more hairs to pass through to the trimming blade 44. In certain embodiments, there may be more than about 20 slots 74, more than about 40 slots 74, or even more than about 50 slots 74 that are spaced closely together. There may be more or less slots 74, depending on the length of the housing 20. The number of slots 74 is based on a standard length housing 20, for example about 35 mm to about 45 mm, however the housing 20 may have a length less than about 35 mm or greater than about 45 mm. The large number of slots 74 may ensure that as much of the trimming blade 44 as possible is used to cut hairs passing though the trimming comb guard 46.

The trimming blade 44 has a trimming cutting edge 60 dimensioned to cut the hair passing through the slots 74. The trimming blade edge 60 may be spaced apart from the trimming comb guard 46 by distance of about 0.1 mm to about 2.0 mm, however, the design of the trimming comb guard 46 may allow for a smaller distance between the trimming comb guard 46 and the trimming blade edge 60. In certain embodiments, the spacing between the trimming comb guard 46 and the trimming blade edge 60 may be less than about 0.05 mm and may even touch the trimming blade edge 60. Hair may track through the slots 74 in the trimming comb guard 46 and cut by the trimming blade edge 60, while the trimming comb guard 46 protects the skin.

The width of a human hair is about 0.10 mm. If the width of the slot 74 is less than about 0.10 mm, then the hair may be caught up in the slot 74 and prevent other hairs from properly passing through the slot 74 and to the blade 44. If the width of the slot 74 is too small it may hamper proper rinsing of the slot 74 and blade 44. Shaving aids, hair, dirt and debris may become trapped within the slot 74, the trimming comb guard 46 and around the blade 44, thus decreasing the effectiveness of the blade 44 to cut hair. This may become even more critical for users that shave infrequently. Longer hairs would be even more likely to become trapped and difficult to rinse out. The longer hairs would also be more likely to trap additional hairs, shaving aids, dirt, and debris. If the slot 74, trimming comb guard 46 and the blade 44 are not properly rinsed, the blade 44 will not properly cut the hair, which may result in nicks, cuts, uncut hairs and an inefficient shave that requires more passes of the blade 44 on the user's skin.

Standard guards can trap longer hairs so that they are held down against the skin when the primary or first blade is designed to engage them. The design of the trimming comb guard 46 allows for hairs to pass through without being trapped. If hair becomes trapped within or under a guard, successive or trailing hairs will not be able to be pushed upright by the guard and thus not presented properly to the blade 44. An upright hair has a greater likelihood of being cut closer by the blade 44. The trimming comb guard 46 also does not pinch the hair as it is cut, but allows the hair to pass through to be cut by the blade 44. The pinching of hair by guards often causes discomfort to the user. The top face of the trimming comb guard 46 manages skin flow and maintains the geometry during trimming.

In manufacture, blade carrier 42 may be cut and formed from sheet metal. Trimming blade 44 is then placed against interior surface of rear wall 56. Trimming blade 44 is then secured to interior surface of rear wall 56 by spot welds. Trimming blade assembly 40 is then placed on the back of housing 20 and secured to housing 20 by clips 32. Other techniques could be used in the manufacture. For example, the trimming comb guard could be part of the molded blade unit, the trimming comb guard could be a separate piece which is secured to the blade unit or to the rear wall and then secured to the blade unit.

Figure 5A:
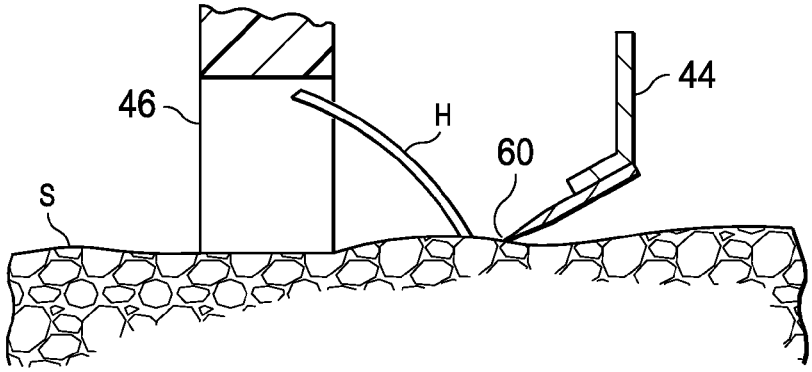
FIGS. 5A, 5B, and 5C are cross sectional side views of a hair being cut by the trimming blade of the shaving razor blade unit of FIG. 4.
Figure 5B:
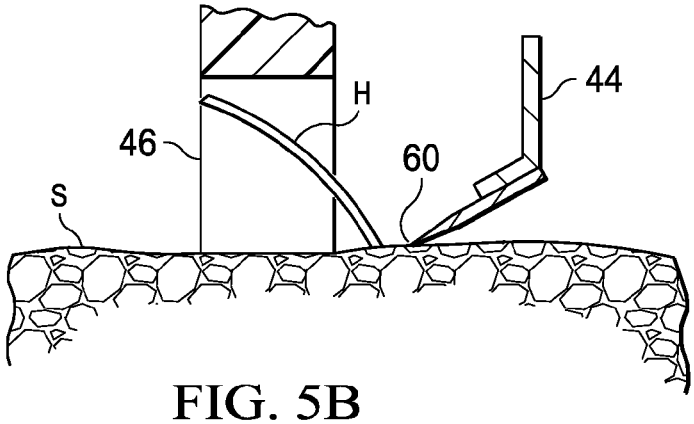
Figure 5C:
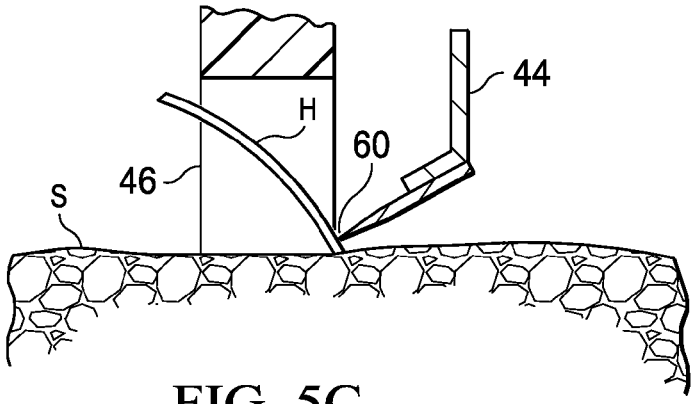

FIGS. 5A-5C illustrate the effect of decreasing blade span, which is the distance from the trimming comb guard 46 to the trimming blade edge 60. FIG. 5A shows a cross sectional side view of a hair "H" being cut by a shaving razor having a generally large blade span between trimming comb guard 46 and the trimming blade edge 60. FIG. 5C illustrates a cross sectional side view of a hair "H" being cut by a shaving razor having a generally small blade span between trimming comb guard 46 and the trimming blade edge 60. FIG. 5B illustrates a cross sectional side view of a hair "H" being cut by a shaving razor having an intermediate blade span between trimming comb guard 46 and the trimming blade edge 60. Typically reducing the span between a blade edge 60 and the trimming comb guard 46 has the effect of improving safety, but decreasing efficiency since more of the blade 44 is masked by the trimming comb guard 46 (as shown in FIG. 5C). Reducing the span between a trimming blade edge 60 and the trimming comb guard 46 may also increase the probability of hairs being trapped under the guard, resulting in a missed or inaccurate cut. The design of the trimming comb guard 46 makes it possible to reduce the span, increasing safety whilst not impacting the efficiency. The trimming blade edge 60 may be masked by the trimming comb guard 46 for the skin "S" but not for the hairs.

Figure 6A:
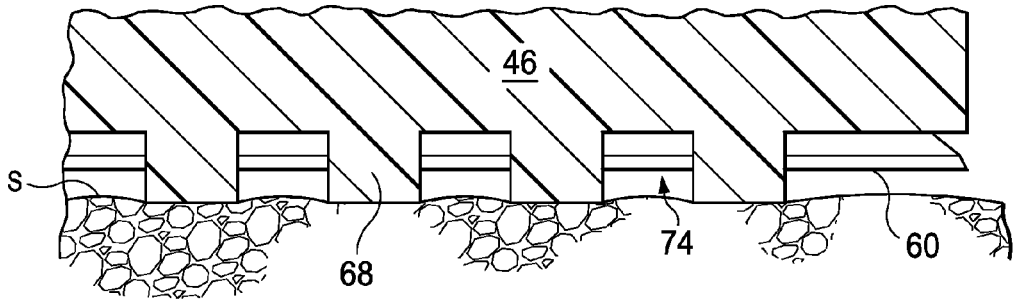
FIG. 6A is a detailed cross sectional view of one embodiment of a trimming comb guard which may be incorporated into the shaving razor blade unit shown in FIG. 4.
Figure 6B:
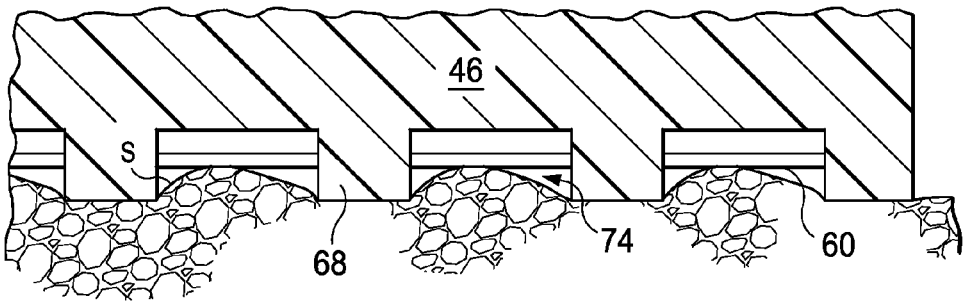
FIG. 6B is a detailed cross-sectional view of another embodiment of a trimming comb guard.

Referring to FIGS. 6A and 6B, the trimming comb guard 46 is shown illustrating the effect of the size of the slots 74 on skin "S". FIG. 6A illustrates the trimming comb guard 46 having a plurality of projections 68 with optimal spacing. The slots 74 of the trimming comb guard 46 may be sized such that only hair travels through the slots 74, thus minimizing the exposure of skin to the blade edge. The trimming blade edge 60 may be moved across the skin parallel to the trimming blade edge 60 without slicing the skin, resulting in a safer design. As the slots 74 get wider, more skin can push up into the slot 74. FIG. 6B illustrates the trimming comb guard 46 having a plurality of projections 68 with increased spacing between adjacent projections 68, such that the skin bulges into the slots 74. The slots 74 expose more of the skin to the trimming blade edge 60, which results in increased likelihood of nicks, cuts, and slices. If the slots 74 are too narrow, hair will not pass through the slots 74, but will be gripped and pulled by the adjacent projections 68. The gripping and pulling of hair is very uncomfortable to the user and often results in hair becoming trapped in the slots 74. The hair is also difficult to rinse out because the hair becomes trapped within the narrow slots 74. The trapped hair then may interfere with cutting of hair in future shaves. The slot 74 should be small enough not to influence comfort, but large enough so hair is able to pass through freely. The trimming comb guard 46 also has the benefit of being rigid enough so the geometry of the slots 74 remains consistent during shaving, thus maintaining optimum blade-skin geometry resulting in a closer and more comfortable shave.

Figure 7:
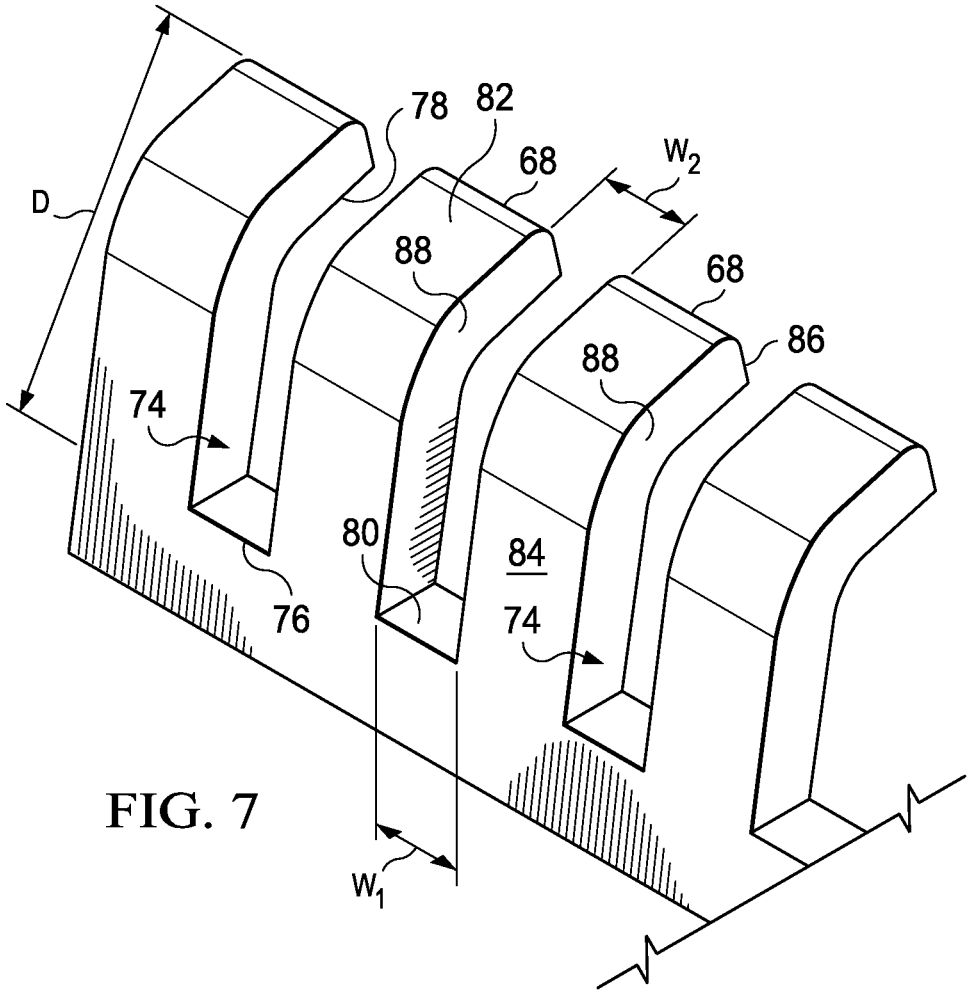
FIG. 7 is a detailed perspective view of a portion of the trimming comb guard of FIG. 4.

Referring to FIG. 7 a detailed perspective view of adjacent projections 68 is shown. A pair of adjacent projections 68 may define the slot 74 that is dimensioned to track hairs through with little or no interaction with the hair so the hair is not captured, trapped, or pulled by projections 68, which may cause discomfort. The slots 74 and projections 68 are spaced to be as small as possible while not interacting with hair. The slots 74 and projections 68 are also dimensioned to reduce skin bulges and pressure points at ends of slots 74, which may result if the projections 74 or slots 68 are spaced to far apart. Skin bulges may lead to the trimming blade edge (not shown) unnecessarily cutting the skin, resulting in discomfort. The relatively larger number of projections 68 over the length of the trimming comb guard may distribute the force placed on the skin. The increased number of slots 74 may also increase the number of hairs passing through the slots 74 of the trimming comb guard, which may increase the number hairs that are properly cut by the trimming blade edge (not shown).

The slot 74 may have a leading end portion 76 that receives one or more hairs and a trailing end portion 78 that feeds the hair to the blade (not shown) for cutting. The leading end portion 76 may have width "$w_1$" of about 0.20 mm to about 0.49 mm; however $w_1$ may be greater than about 0.49 mm and smaller than about 0.20 mm as long as $w_1$ is greater than the diameter of a hair. The trailing end portion 78 may have a width "$w_2$" of about 0.20 mm to about 0.49 mm; however $w_2$ may be greater than about 0.49 mm and smaller than about 0.20 mm as long as $w_2$ is greater than the diameter of a hair. The leading end portion 76 of the slot 74 may have a chamfer or a lead in that tapers from the leading end portion 76 to the trailing end portion 78 to provide more efficient handling and passage of the hair.

The projections 68 may have a height as measured from a bottom surface 80 to a top surface 82 of the projections 68. The height of the projections 68 may be between about 0.25 mm to about 2.0 mm, for example a height of about 1.5 mm. The height dimension of the projections 68 correlates directly to the depth "D" of the slots 74. Thus, the slots 74 may have a depth "D" between about 0.25 mm to about 2.0 mm, for example a depth of about 1.5 mm.

The slots 74 have an aspect ratio of depth of slot to width of slot between about 1:1.25 to about 5. The aspect ratio of depth of slot to width of slot in this range allows the hair to track through the slot for efficient cutting by the trimming blade. If the slot width is too small and the depth is too small the hair will not have sufficient room to maneuver within the slot to be efficiently cut by the trimming blade. Alternatively, if the width is too large and the depth is too large the hair may have unlimited movement within the slot and not properly track through the slot and not be efficiently cut by the trimming blade.

Figure 8:
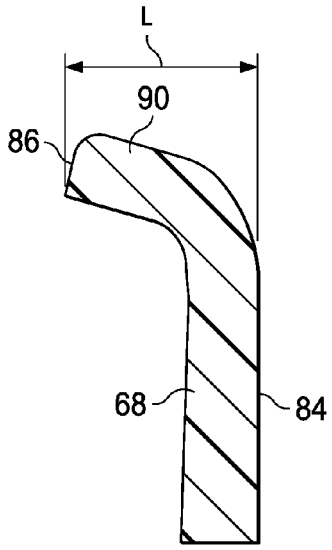
FIG. 8 is a side view of one projection of the trimming comb guard of FIG. 4.

Referring now to FIGS. 7 and 8, the projections 68 may have a length "L" as measured from a front face 84 of the projection 68 to a rear face 86. The length "L" of the projections 68 may be between about 0.50 mm to about 2.0 mm, for example a length of about 1.5 mm. As viewed from the side, the projections 68 have an L-like shape providing an extended or overhang section 90. The overhang 90 may be between about 0.30 mm to about 1.0 mm, for example 0.80 mm. The overhang section 90 creates a larger length "L" for improved tracking of hair through slot 74.

The slot 74 may extend beyond the front face 84 of the adjacent projections 68 resulting in a slightly greater length of the slot than the length of the adjacent projections 68. The height of the projections 68 may be tapered or stepped such that the height of the projections 68 form the leading end portion 76 of the slots 74 is less than the height of the projections 68 that form the trailing end portion 78 of the slots 74. A step design may increase strength and may improve the tracking of hair into the slot 74. The pitch or spacing of the slot 74, as measured from a first side surface 88 of one of the projections 68 to a first side surface 88 of the adjacent projection 68, may have a range of about 0.40 mm to about 1.5 mm, or about 0.80 mm. The total number of slots 74 may be greater than 50, greater than about 60, greater than about 70, or even greater than about 80, depending on pitch and length of the housing 20.

Figure 9:
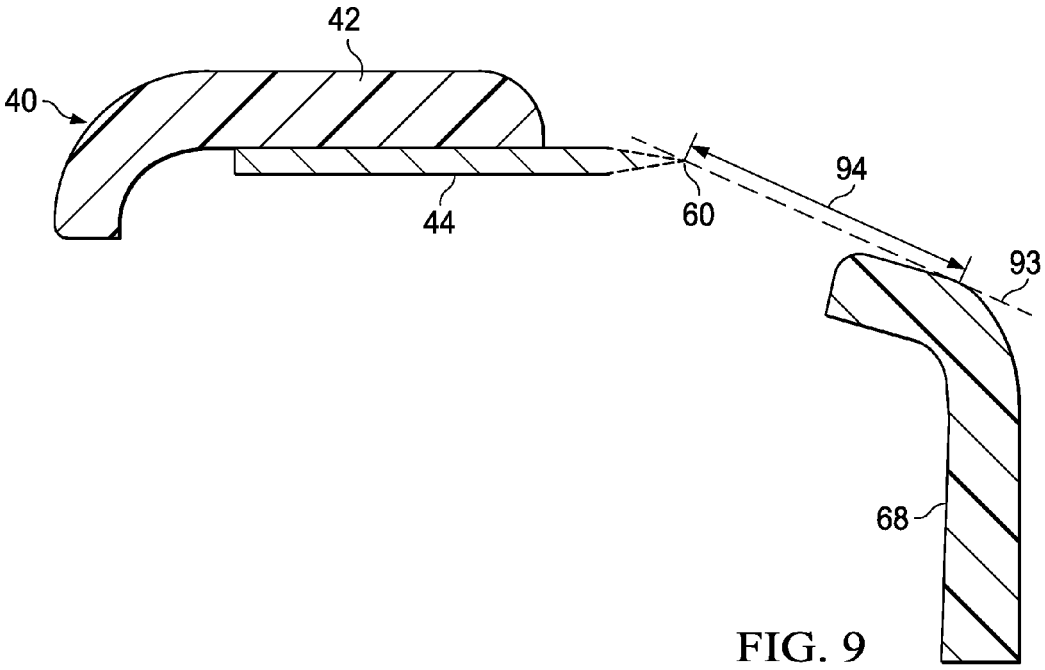
FIG. 9 is a cross-sectional side view of the trimming blade assembly of FIG. 4.

Referring now to FIG. 9, a cross sectional view of trimming blade assembly 40 is shown. Trimming blade assembly includes blade carrier 42 and trimming blade 44 mounted thereon. Trimming blade 44 includes cutting edge 60. A trimming blade span 94 is measured along a tangent line 93 drawn from cutting edge 60 to the tangent surface of projection 68. The trimming blade span may have a range of about 0.1 mm to about 2.0 mm, or about 0.90 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor blade unit comprising:

a housing having a primary guard at a front of said housing and a primary cap at an upper surface at a back of said housing, one or more primary shaving blades positioned between said primary guard and said primary cap, a trimming blade mounted at the back of said housing having a cutting edge, and a trimming comb guard at said back of said housing, said trimming comb guard having a plurality of projections along a length of the trimming comb guard defining a plurality of open slots extending generally perpendicular to the cutting edge, wherein each of the plurality of projections has an L-shape comprising a leading end portion and a trailing end portion, and the open slots taper from the leading edge portion to the trailing edge portion and have a width ranging from about 0.20 mm to about 0.49 mm for allowing free passage of hair during shaving.

2. The unit of claim 1 wherein said trimming comb guard is made of sheet metal that has been cut and formed.

3. The unit of claim 1 wherein said open slots have a pitch of about 0.40 mm to about 0.85 mm.

4. The unit of claim 1 wherein plurality of projections includes at least about 50 projections along the length of the trimming comb guard.

5. The unit of claim 1 wherein the open slots are directly adjacent the trimming blade.

6. The unit of claim 1 wherein the open slots have a substantially uniform width.

7. The unit of claim 1 wherein the open slots are generally parallel to each other.

8. The unit of claim 1 wherein the slots have an aspect ratio of a depth of slot to a width of slot between about 1:125 to about 5.

9. The unit of claim 1 wherein the unit has a trimming blade span between the trimming comb guard and the trimming blade edge of between about 0.1 mm to about 2.0 mm.

10. A shaving razor blade unit comprising:

a housing having a primary guard at a front of said housing and a primary cap at an upper surface at a back of said housing, one or more primary shaving blades positioned between said primary guard and said primary cap, a trimming blade mounted at the back of said housing having a cutting edge, and a trimming comb guard at said back of said housing, said trimming comb guard having a plurality of projections along a length of the trimming comb guard defining a plurality of open slots extending generally perpendicular to the cutting edge, wherein each of the plurality of projections has an L-shape comprising a leading end portion and a trailing end portion, and the open slots taper from the leading edge portion to the trailing edge portion and have a width ranging from about 0.20 mm to about 0.49 mm for allowing free passage of hair during shaving and a pitch of about 0.40 mm to about 0.85 mm.

11. The unit of claim 10 wherein said trimming comb guard is made of sheet metal that has been cut and formed.

12. The unit of claim 10 wherein the plurality of projections includes at least about 50 projections along the length of the trimming comb guard.

13. The unit of claim 10 wherein the open slots are directly adjacent the trimming blade.

14. The unit of claim 10 wherein the open slots are generally parallel to each other.

15. A shaving razor blade unit comprising:

a housing having a primary guard at a front of said housing and a primary cap at an upper surface at a back of said housing, one or more primary shaving blades positioned between said primary guard and said primary cap, a trimming blade mounted at the back of said housing having a cutting edge, and a trimming comb guard at said back of said housing, said trimming comb guard having a plurality of projections along a length of the trimming comb guard defining a plurality of open slots extending generally perpendicular to the cutting edge and directly adjacent the trimming blade, wherein each of the plurality of projections has an L-shape comprising a leading end portion and a trailing end portion, and the open slots taper from the leading edge portion to the trailing edge portion and have a width ranging from about 0.20 mm to about 0.49 mm for allowing free passage of hair during shaving and a pitch of about 0.40 mm to about 0.85 mm.

16. The unit of claim 15 wherein said trimming comb guard is made of sheet metal that has been cut and formed.

17. The unit of claim 15 wherein the plurality of projections includes at least about 50 projections along the length of the trimming comb guard.

18. The unit of claim 15 wherein the open slots are generally parallel to each other.

* * * * *